US005127860A

United States Patent [19]

Kraft

[11] Patent Number: 5,127,860

[45] Date of Patent: Jul. 7, 1992

[54] SURF SAFE

[76] Inventor: Russell A. Kraft, 2632 Ohio Ct., Las Vegas, Nev. 89128

[21] Appl. No.: 631,364

[22] Filed: Dec. 17, 1990

[51] Int. Cl.[5] ..... B63B 19/00

[52] U.S. Cl. ..... 441/74

[58] Field of Search ..... 441/74; 114/39.2, 201 R

[56] References Cited

U.S. PATENT DOCUMENTS 4,955,835 9/1990 Hollingsworth ..... 441/74

FOREIGN PATENT DOCUMENTS 3107065 9/1982 Fed. Rep. of Germany ..... 441/74
3330504 3/1984 Fed. Rep. of Germany ..... 114/39.2
3325819 12/1984 Fed. Rep. of Germany ..... 441/74

*Primary Examiner*—Jesus D. Sotelo

[57] ABSTRACT

A modular receptacle to recess in a surfboard or the like for providing safe watertight containment of items placed therein having a body, two stringer clamps, a lid, a lid securing finger dial, a gasket for providing a watertight seal between the body and the lid and a washer for providing a watertight seal between the lid and the finger dial. The body is oblong and has two side walls, a front wall, a back wall and divider walls within forming separate compartments. There are openings in the front and back walls for the stringer clamps to push through onto a centered stringer of the surfboard therefor replacing shear strength lost from the surfboard due to the rout out opening necessary for a centered installation. A ledge is formed around the inner perimeter of the front, side and back walls serving as a gasket and lid rim seat. There is a post which extends up from the bottom wall of the body having female threads within. The lid is thin with four straight edges and is of exact size to fit within the walls of the body and rest on the ledge therein. The lid has a circular recess in the upper surface where a washer seats, and has a female threaded hole in an extension below the recess passing through to the center of the recess. The finger dial has a circular plate with indentations in the upper surface and a post which extends down from the center of the lower surface having male threads at the extremity. The male threads of the finger dial rotate through the female threaded hole in the extension below the circular recess in the lid. The lid seats on the gasket of the ledge within the walls of the body, then the male threads of the finger dial rotate down into the female threaded post within the body, therefor securing the lid to the body. When the lid and finger dial are snug they are flush with the upper edge of the body.

6 Claims, 6 Drawing Sheets

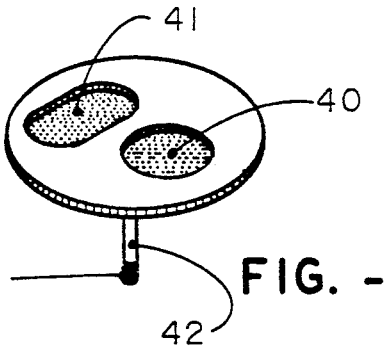
FIG. - 5
FIG. - 4
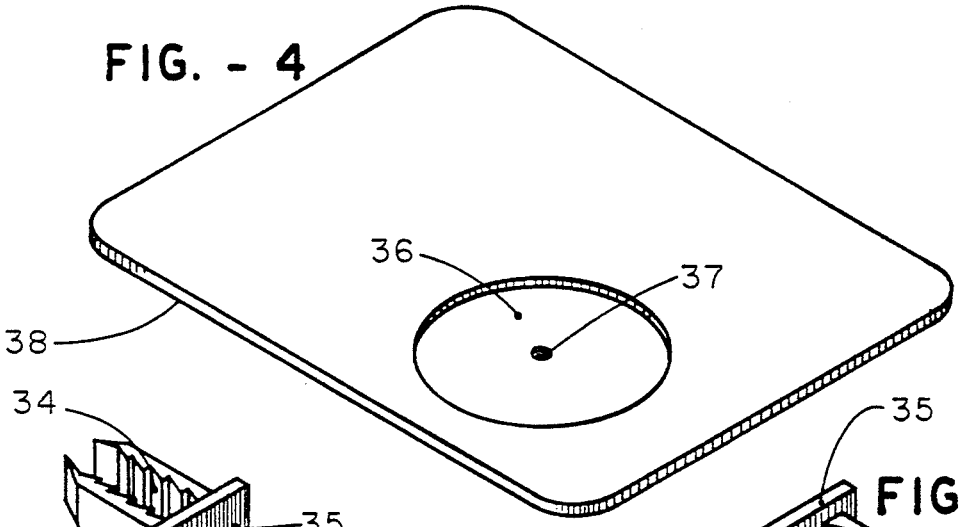
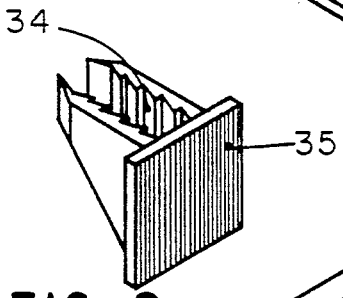
FIG.-2
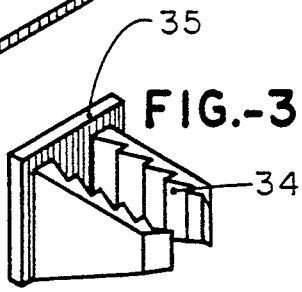
FIG.-3
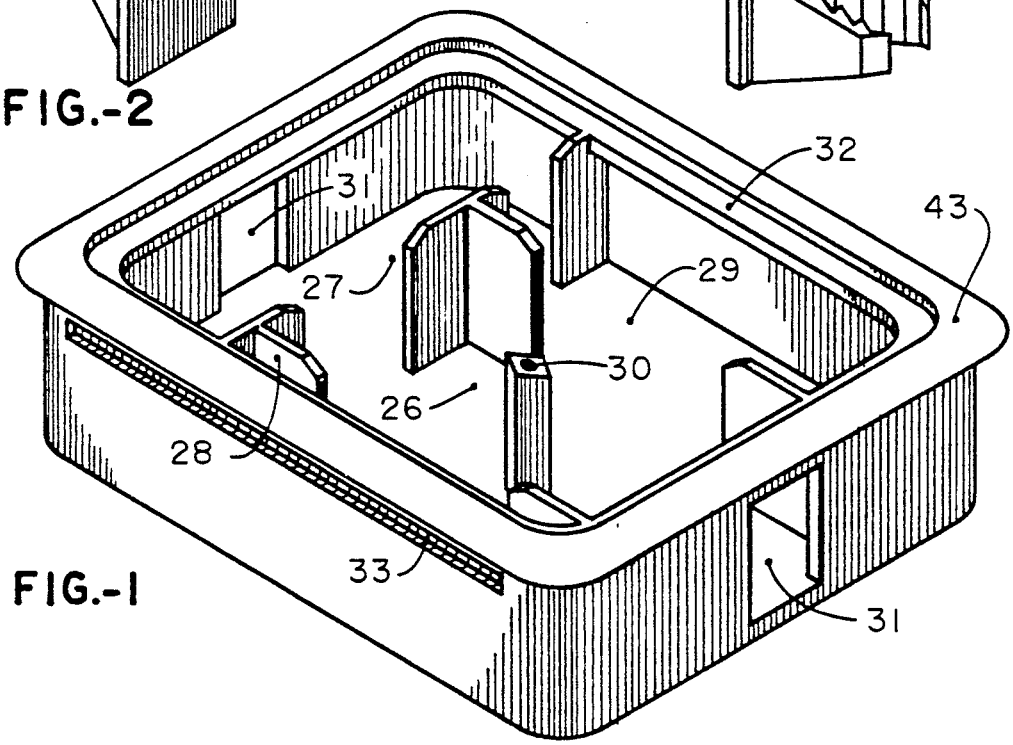
FIG.-1

SURF SAFE

BACKGROUND OF THE INVENTION

Presently there are many problems associated with the process of preparing for surfing or related water board sports, such as Windsurfing, Paddleboarding, and Kneeboarding. These problems include the safe storage of keys to vehicles or places of residence. It is critical to have a safe and worry free location to store keys without risk of theft, accidental loss, or inconvenience. Another problem is the storage and convenient access to wax. Wax is used to achieve a non-slip surface on the deck of the board. It never seems to be available when needed, and if it is it's usually contaminated with sand and other foreign debris, or melted making a mess of everything. The surface of the wax on the board or lack thereof, often becomes slippery due to water temperature or continued use. It then becomes necessary to roughen up the surface of the wax with a wax comb, or in most cases sand is used to achieve a non-slip capability due to the unavailability of a wax comb. Sand contaminates the wax causing irritation to the skin, and is unsightly on the surface of the board. When the wax on the deck of the board becomes aged, dirty, or contaminated with sand it is necessary to remove it with a wax scraper, then apply new wax. Another item in need of safe convenient storage during the process of surfing is paper money. Presently many surfers hide these items leaving them vulnerable to theft, loss, and inconvenience. The object of this invention is to provide a safe easily accessible location to store the aforementioned items while preparing for and during the process of surfing and related water board sports.

This invention is unique and popularity is expected to be abound. The only similar device known to be available is called a wax stash. A wax stash is a piece of tupperware that holds wax and prevents contamination. The wax is still susceptible to theft, loss, or melting when left unattended. There are wetsuit and swimsuit pockets that allow storage of keys and money, but this method causes discomfort and risk of loss.

An international preliminary search of prior art has been conducted in the United States, and nothing even remotely similar was found.

A BRIEF SUMMARY OF THE INVENTION

This invention hereafter referred to as "Surf Safe" is a rectangular shaped receptacle that will provide safe storage of, an convenient access to keys, wax, wax comb, wax scraper, paper currency, and lip or nose ointments. It will be countersunk into the deck surface of a surfboard or related water sport board so as to eliminate interference while in use. It has rounded corners for ease of application into a routed out opening into the deck surface. It will be centered from left to right for balance, and slightly forward from mid point front to back for momentum. "Surf Safe" has a dual stringer clamp design to replace shear strength lost from the routed opening in boards with centered stringers. It has divider walls within to separate and secure the intended contents during use or transport. "Surf Safe" is designed with a dual gasket washer system to achieve a watertight ability when the lid is closed and secured.

"Surf Safe" will be composed of a durable, flexible, lightweight plastic such as Kevlar or Polypropylene, and the main components will be produced by an injection mold process, to assure strength and durability.

The compartment for the keys within "Surf Safe" will have a secured pouch with a Velcro strap to prevent unwanted movement during use of the board. The compartment for the wax has a post in the center to prevent the wax from shifting during use. This same post will serve as the female threaded receiver for the male threaded lid securing finger dial. The wax for "Surf Safe" will be unique in size and shape to adapt for storage in the compartment. The wax comb will fit snugly into the designated compartment. Also the container for paper currency or lip and nose ointments will fit snuggly into the proper compartment. This container will resemble a film container and be watertight.

The utilization of "Surf Safe" will eliminate many risks, burdens, sacrifices, and inconveniences presently associated with the preparation and execution of surfing or related water sport. It will make these activities safer and more enjoyable.

A BRIEF DESCRIPTION OF THE DRAWINGS

FIG. 1 is a perspective view of the body.

FIG. 2 is a perspective view of one of the stringer clamps.

FIG. 3 is a perspective view of the other stringer clamp.

FIG. 4 is a perspective view of the lid.

FIG. 5 is a perspective view of the lid securing finger dial.

A DETAILED DESCRIPTION OF THE DRAWINGS

Figure 12:
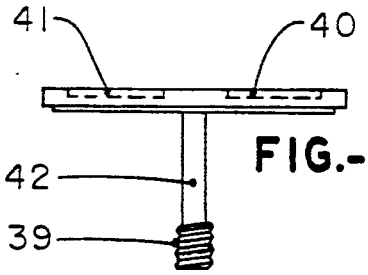
FIG. 12 is a see through side view of the lid securing finer dial.

Referring now to FIG. 1,2,3,4 & 5 these are perspective views of the main components of "Surf Safe" all of which will be made of a durable, slightly flexible, lightweight plastic such as Polypropylene or Kevlar. They will be produced in an injection mold process to assure strength.

Referring to FIG. 1 there is shown a receptacle, this is the body of the invention, it has divider walls within forming four compartments, the wax compartment 26, the key compartment 27, the wax comb compartment 28, and the watertight container compartment 29. These divider walls have openings in them to allow finger access to any item within the compartments. The post 30 in the center of the wax compartment 26 will prevent "Surf Safe" wax FIG. 20 from shifting during use or transport of the surfboard FIG. 25 or related water sport vehicle. The center of this same post 30 is hollow, the upper third section being a slightly larger opening with no threads, and the lower two thirds having female threads to accept the male threads 39 of the lid securing finger dial FIG. 5. This feature is better shown in FIG. 6 reference 30 an FIG. 12 reference 39.

Within the body FIG. 1 there is shown a lid rim seat 32 extending around the inner perimeter. The lid rim seat gasket FIG. 16 when placed on this lid rim seat 32 will provide a watertight capability when the lid FIG. 4 is secured by the lid securing finger dial FIG. 5. The body FIG. 1 has a tapered lip 43 around the upper outer perimeter which will rest on the deck surface 49 of a surfboard FIG. 25 or related water sport vehicle and cover the cut edge of the routed opening during installation. On both sides of the body FIG. 1 there is a groove 33 which will provide greater bonding strength to the route opening in the surfboard FIG. 25 or related water sport vehicle. When the resin used to secure it is applied it will penetrate this groove 33 and once cured will provide the added strength. There is also shown in the body FIG. 1 openings 31 on each end which will allow the teeth 34 of the stringer clamps FIG. 2 & 3 to pass through onto a centered stringer 48 of a surfboard FIG. 25 or related water sport vehicle during installation.

Referring to FIGS. 2 & 3 the stringer clamps there is shown the backing plates 35, they are larger in height and width than the openings 31 in the body FIG. 1 to prevent them from passing all the way through. When installed the backing plates 35 will rest against the inside wall of the body FIG. 1. The teeth 34 will pass through the openings 31 of the body FIG. 1 onto the centered stringer 48 of a surfboard FIG. 25 or related water sport vehicle. Once they're resined in they will replace shear strength lost from the board due to the route opening. The space between the teeth 34 will be varied depending on the width of the centered stringer 48 it is applied to. The stringer clamps are not needed for installations into surfboards or related water sport vehicles without centered stringers.

Referring now to FIG. 4 there is shown the lid for "Surf Safe". The edge 38 will serve as a wax scraper to remove unwanted wax from the deck surface 49 of a surfboard FIG. 25 or related water sport vehicle. On the lid there is shown the lid securing finger dial washer seat 36, the lid securing finger dial washer FIG. 18 will be placed there to provide a watertight capability when the lid securing finger dial FIG. 5 is tightened down to the female threaded post 30 within the body FIG. 1. There are female threads 37 in the lid FIG. 4 to allow the male threads 39 of the lid securing finger dial FIG. 5 to rotate through.

Referring to FIG. 5 there is shown the lid securing finger dial it is used to secure the lid FIG. 4 to the body FIG. 1. The male threads 39 will rotate through the female threads 37 of the lid FIG. 4 until the section with no threads 42 passes freely through. The indentation for the thumb 40 and the indentation for the index finger 41 will have a roughened surface to prevent slipping when tightening the lid FIG. 4.

Figure 11:
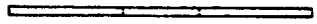
FIG. 11 is a see through side view of the lid securing finger dial washer.
Figure 10:
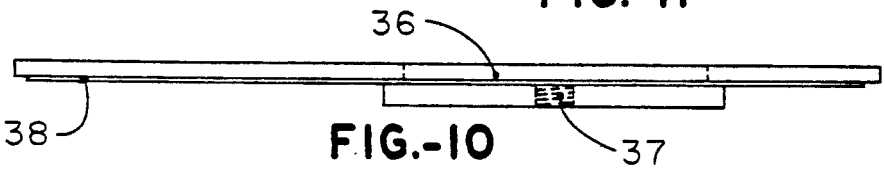
FIG. 10 is a see through side view of the lid.
Figure 9:
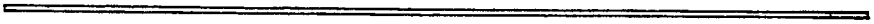
FIG. 9 is a see through side view of the lid rim seat gasket.
Figure 7:
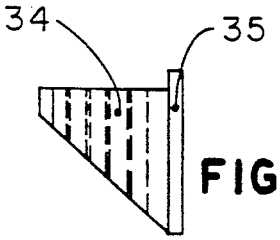
FIG. 7 is a see through side view of one of the stringer clamps.
Figure 8:
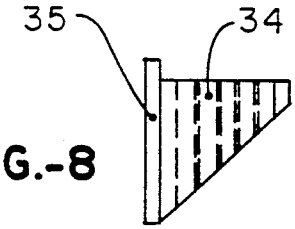
FIG. 8 is a see through side view of the other stringer clamp.
Figure 6:
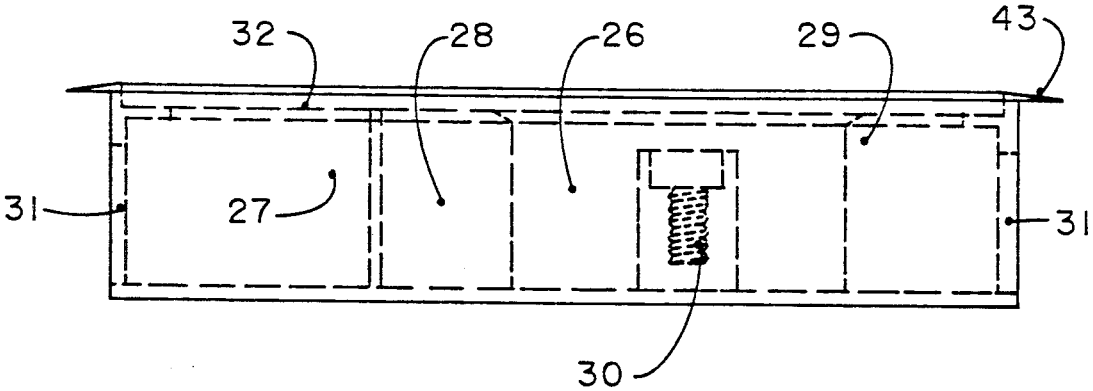
FIG. 6 is a see through side view of the body.

Referring now to FIGS. 6,7,8,9,10,11 & 12 these are side views of the main components of "Surf Safe". Included are the lid rim seat gasket FIG. 9 and lid securing finger dial washer FIG. 11 both of which are made of Neoprene rubber for use in salt water an both will have water resistant adhesive on the bottom side so they will adhere to their seat. The side views shown FIG. 6–12 are shown in the order of assembly from the bottom up. The order is as follows, first the body FIG. 6 will be installed into a routed opening, then the teeth 34 of the stringer clamps FIG. 7 & 8 are pushed through the openings 31 in the body FIG. 6 until the backing plates 35 of the stringer clamps FIGS. 7 & 8 are against the inner wall of the body FIG. 6. Then the lid rim seat gasket FIG. 9 is placed with adhesive side down onto the lid rim seat 32 of the body FIG. 6. The lid FIG. 10 is then placed in position onto the lid rim seat gasket FIG. 9 within the outer lip 43 of the body FIG. 6. Now the lid securing finger dial washer FIG. 11 is placed in position with the adhesive side down onto the lid securing finger dial washer seat 36 of the lid FIG. 10. Then the male threads 39 of the lid securing finger dial FIG. 12 are rotated through the female threads 37 of the lid FIG. 10. The upper third section in the hollow center of the post 30 within the body FIG. 6 is wider than the lower section and has no threads, this will allow the lifting of the lid FIG. 10 with the lid securing finger dial FIG. 12 once the male threads 39 pass through the female threads 37 of the lid FIG. 10. To secure the lid FIG. 10 to the body FIG. 6 the thumb and index finger are used in the indentations 40 & 41 of the lid securing finger dial FIG. 12 to rotate the male threads 39 down through the female threaded section of the post 30 until tight. "Surf Safe" will now have a watertight capability because the lid FIG. 10 is tight against the rubber gasket FIG. 9 and the lid securing finger dial FIG. 12 is tight against the rubber washer FIG. 11.

Figure 16:
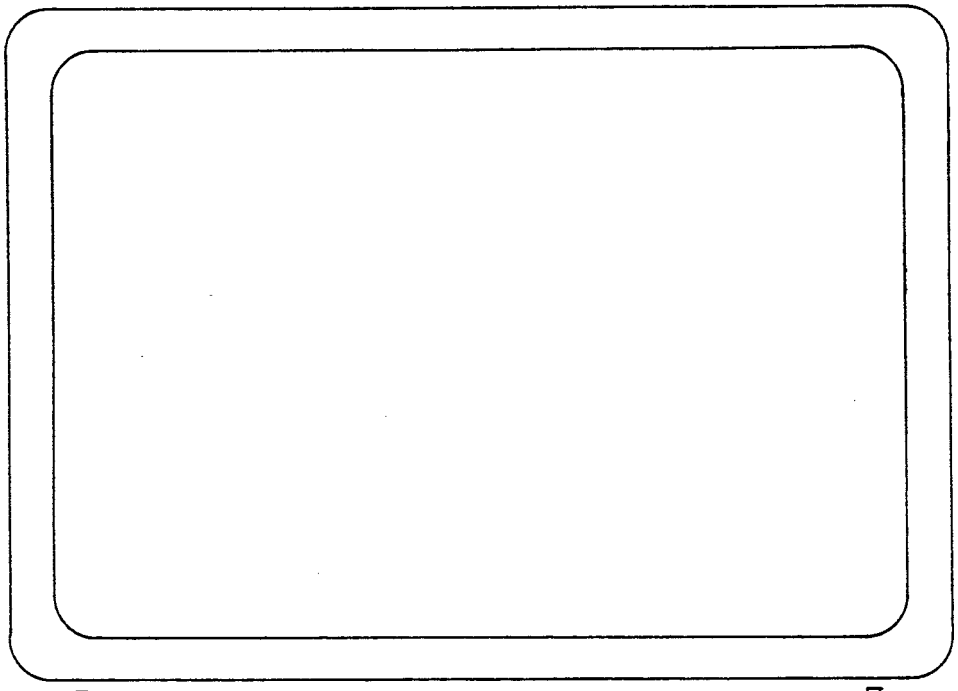
FIG. 16 is a top view of the lid rim seat gasket.
Figure 14:
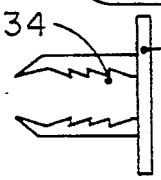
FIG. 14 is a top view of one of the stringer clamps.
Figure 15:
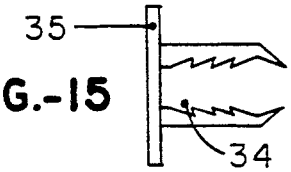
FIG. 15 is a top view of the other stringer clamp.
Figure 13:
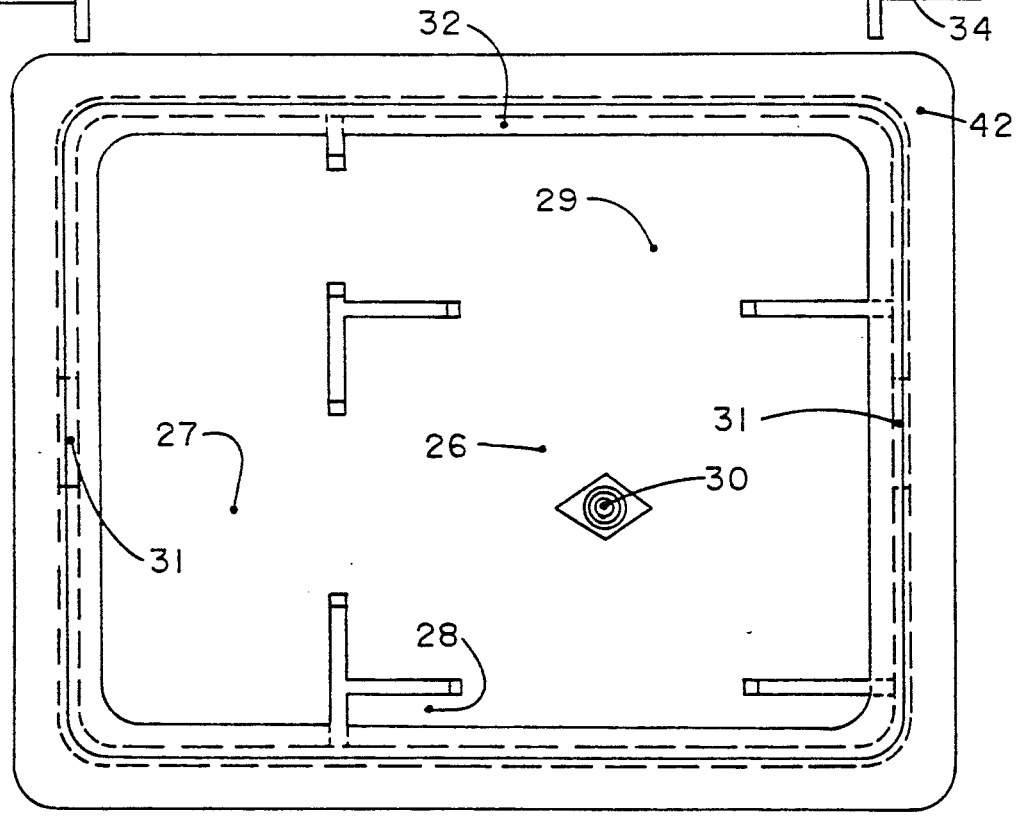
FIG. 13 is a see through top view of the body.
Figure 19:
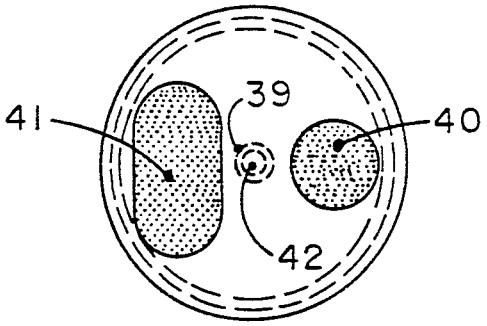
FIG. 19 is a see through top view of the lid securing finger dial.
Figure 18:
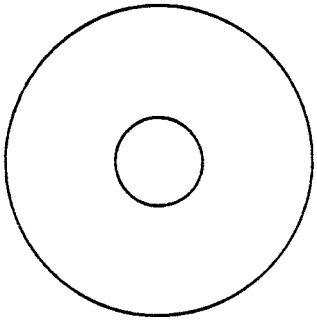
FIG. 18 is a top view of the lid securing finger dial washer.
Figure 17:
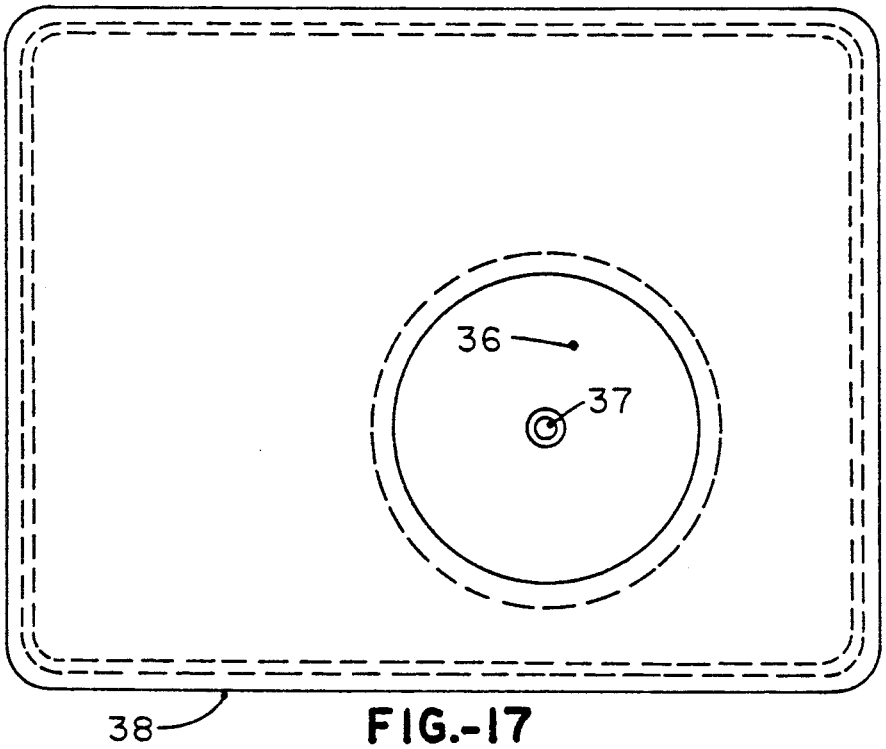
FIG. 17 is a see through top view of the lid.

Referring now to FIG. 13–19. When FIGS. 17–19 are placed above FIG. 13–16 these top views are in the same assembly order as FIGS. 6–12. All of the components in these views are marked with the same reference characters and are labeled as follows FIG. 13 is the body, part of which is the wax compartment 26, the key compartment 27, the wax comb compartment 28, the watertight container compartment 29, the post 30, the openings 31, the lid rim seat 32, and the tapered lip 43. FIG. 14 & 15 are the stringer clamps with the teeth 34 and the backing plates 35. FIG. 16 is the lid rim seat gasket. FIG. 17 is the lid, with the edge 38 which is used as a wax scraper, and the lid securing finger dial washer seat 36 with the female threaded opening 37. FIG. 18 is the lid securing finger dial washer. FIG. 19 is the lid securing finger dial with the male threads 39, the section with no threads 42, the indentation for the thumb 40 and the indentation for the index finger 41.

Figure 23:
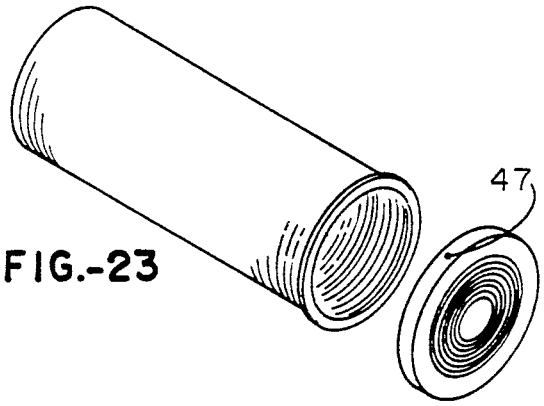
FIG. 23 is a perspective view of the watertight container.
Figure 21:
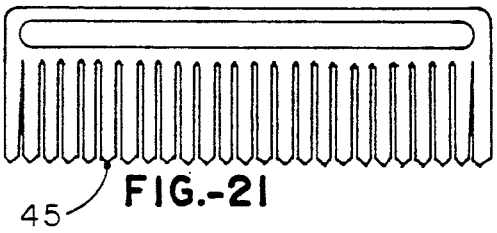
FIG. 21 is a side view of the wax comb.
Figure 22:
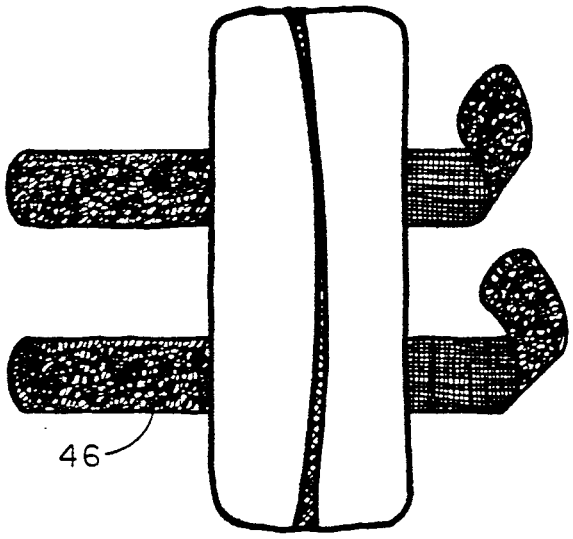
FIG. 22 is a top view of the pouch with a Velcro strap for the keys.
Figure 20:
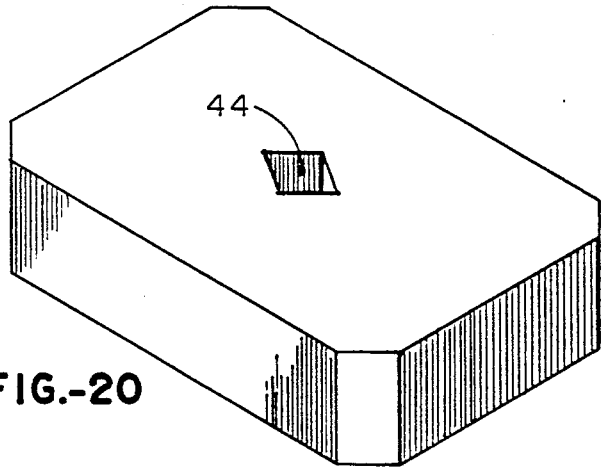
FIG. 20 is a perspective view of "Surf Safe" wax.

Referring now to FIGS. 20,21,22 & 23, these are the items high will fit into each of the compartments within the body FIG. 13. FIG. 20 is a perspective view of "Surf Safe" wax. It has a diamond shape hole 44 in the center to allow it to pass through the post 30 within the wax compartment 26 of the body FIG. 13. FIG. 21 is the wax comb, it has teeth 45 which are used to roughen up the surface of the wax when slippery. FIG. 22 is the key pouch with Velcro strap 46. The pouch FIG. 22 will be secured within the key compartment 27 of the body FIG. 13 with a velcro strip an water resistant adhesive to prevent the keys in the pouch from moving or falling out when strapped in FIG. 23 is a perspective view of the watertight container with lid 47, it will fit snuggly within the container compartment 29 within the body FIG. 13.

Figure 24:
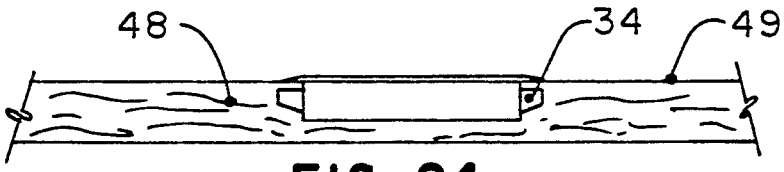
FIG. 24 is a cut-away side view of a surfboard with "Surf Safe" installed

Referring to FIG. 24, this is a cut-away side view of a "Surf Safe" inlayed into the deck surface 49 of a surfboard with a centered stringer 48. This view shows the teeth 34 of the stringer clamps FIGS. 7 & 8 locked onto the stringer 48 replacing shear strength lost from the routed opening in the stringer 48 of the surfboard FIG. 25 or related vehicle.

Figure 25:
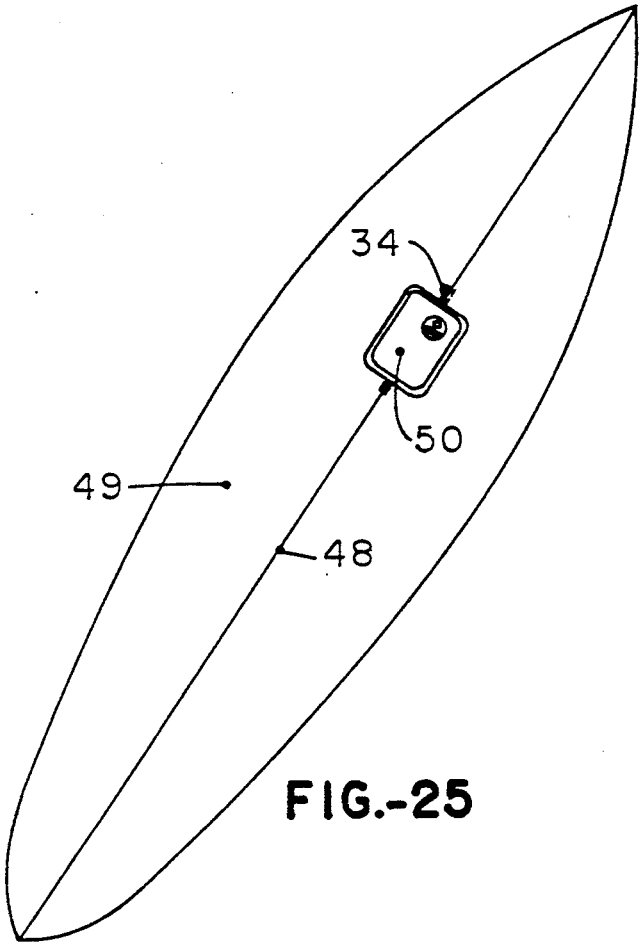
FIG. 25 is a top view of a surfboard with "Surf Safe" installed.

Referring to FIG. 25, this is a top view of a surfboard with a centered stringer 48 with "Surf Safe" installed.

The following is a description of the installation procedure of "Surf Safe". First it is necessary to rout an opening in the deck surface 49 of a surfboard FIG. 25 using a high speed router with a ½" dia. bit to accomodate the rounded corners of the body. The routed opening's location in the deck surface 49 is critical to the surfboard FIG. 25 performance after installation and during use. The routed opening should be centered from left to right for balance, slightly forward from the balance point front to back, and the flattest thickest section within that area. These requirements only apply to high performance surfboards FIG. 25. In larger boards known as loggers or in long paddleboards such as lifeguards use the location is not so critical, although a centered location for balance will provide superior performance. Once the opening's location is determine it is again critical to make the opening of exact size to allow the body FIG. 6 to fit precisely. The exact depth will be achieved by adjusting the cutting depth of the router and the exact shape will be achieved by the use of a jig to guide the router. After the opening is routed it is then necessary to apply a coat of resin to the entire surface within the opening. In cases of fiberglass sheathing, a thin stip of fiberglass cloth is applied to the cut edge of the deck surface at the opening. The perimeter of the opening on the deck surface within ¼" of the cut edge is sanded for greater bonding strength and the fiberglass cloth strip will be placed with resin around the edge of the opening within ¼" on the deck surface so when the body FIG. 6 is set the tapered lip 43 will cover it. While the resin is still wet the body FIG. 6 is also coated with resin on the bottom and side surfaces including the grooves 33 and the underside of the tapered lip 43, it is then placed into the opening until the tapered lip 43 is resting on the deck surface 49 as shown in FIG. 24. If the surfboard FIG. 25 has a centered stringer 48 it is necessary to replace shear strength lost by cutting into it. This is accomplished with the stringer clamps FIG. 2 & 3 by applying resin to the teeth and pushing them through the openings 31 in the body FIG. 1 onto the stringer 48 as shown in FIG. 24 reference 34. The teeth 34 of the stringer clamps FIG. 2 & 3 will grip onto the centered stringer 48 of the surfboard FIG. 25 and when the resin cures will bond them, therefore replacing shear strength lost from the board. In cases of installation into surfboards without centered stringers then the stringer clamps are not needed. All excess resin around the lip 43 of the body FIG. 1 should be wiped away before curing. Now the body FIG. 1 within the opening is given time to let the resin cure. Once the resin has cured "Surf Safe" is ready for assembly.

The gasket FIG. 16 is placed on the seat 32 of the body FIG. 13 then the washer FIG. 18 is placed in it's seat 36 on the lid. Then the key pouch FIG. 22 is placed with adhesive side down into the key compartment 27 of the body FIG. 13. The wax FIG. 20 is placed in the wax compartment 26, the wax comb FIG. 21 is placed in the wax comb compartment 28, and the watertight container FIG. 23 is placed in it's compartment 29 in the body FIG. 13. Now the lid FIG. 17 is put in place on the gasket seat 32 of the body FIG. 13. The final step is to secure the lid FIG. 4 to the body FIG. 1 with the lid securing finger dial FIG. 5 by rotating the male threads 39 through the female threads 37 of the lid FIG. 4 and the post 30 of the body FIG. 1. "Surf Safe" is now ready for use. The lid FIG. 4 can be removed by rotating the lid securing finger dial FIG. 5 counter clockwise until the male threads 39 have risen above the female threads of the post 30 of the body FIG. 6, then by pulling up with the lid securing finger dial FIG. 12 the lid FIG. 10 will raise off.

The function of "Surf Safe" is to store "Surf Safe" wax and a wax comb constantly, even when the surfboard FIG. 25 or related water sport vehicle is not being used, or is in storage. Whereas the key pouch and watertight container are used to store keys and other small personal items when preparing for an during the process of surfing or related water sport activity. A surfer will have piece of in knowing his or her keys and money are safe within their board. Never having to hide them or have them stolen again. Also there will never be a time when he or she has to use sand on the wax of their boards, because of constant access to a wax comb right within their board. Also the constant access to "Surf Safe" wax.

After having thus described and illustrated the invention as a preferred embodiment it should be understood that minot modifications or changes may be made therein without abandoning the spirit or function of the invention as stated in the appended claims.

I claim:

1. A modular receptacle to recess in a surfboard for providing safe watertight containment of items placed therein, comprising:

an integrally formed oblong body having a bottom wall, two side walls, a front wall and a back wall, said side, front and back walls having rounded upright corners, said front and back walls each having an opening which is centered between said side walls, said body having divider walls within forming separate compartments and a ledge which is formed on the interior surface around the perimeter of said side, front and back walls adjacent to the top edge, said body also having a post which extends up perpendicular to said bottom wall, said post having a hollow cylindrical center with female threads within the lower section with the upper section being slightly wider with no threads, said body also having a thin tapered lip extending out around the perimeter of said side, front and back walls and grooves formed in the outer surface of said side walls;

two integrally formed stringer clamps for pushing through said openings in the front and back walls of said body, said stringer clamps each having a rectangular backing plate being wider than said openings in the front and back walls of said body, said backing plates each having two parallel walls extending out perpendicular to said backing plates, said parallel walls having a series of teeth formed on the surfaces facing each other;

a thin integrally formed oblong lid having an upper surface with a circular recess, and a lower surface having an extension below said recess in the upper surface, said extension having a female threaded hole passing through to the center of said circular recess in said upper surface, said lid having four straight edges with the outer corners being round, also having a small ridge on said lower surface around the perimeter just within the outer edge;

an integrally formed lid securing finger dial having a circular plate with finger grip indentations in the upper surface and a cylindrical post extending down from the center of the lower surface, said cylindrical post having male threads at the extremity for threaded engagement with the female threads within said post of said body thus securing said lid to said body, said lower surface of said finger dial also having a small ridge around the perimeter just within the outer edge;

a gasket for seating on said ledge within said body for providing a watertight seal between said lid and said body;

a washer for seating within said circular recess in the upper surface of said lid providing a watertight seal between said finger dial and said lid;

said body, lid and finger dial being placed in a recess flush on the deck surface of said surfboard.

2. A modular receptacle according to claim 1 wherein the outer dimensions of said lid edges are smaller than the inner dimensions of said side, front and back walls of said body, said lid being received within said body and when placed therein will rest on said gasket seated on said ledge, said female threaded hole in said lid being directly above said female threaded post within said body therefor allowing said male threads of said finger dial to be threaded through said female threads in said lid and down into the female threads within said post in said body, and when said lid and said finger dial are snug said lid lower surface ridge embeds in said gasket seated on said ledge within said body and said finger dial lower surface ridge embeds in said washer seated within said circular recess in the upper surface of said lid.

3. A receptacle according to claim 1 whereby said stringer clamps are pushed through said openings in said front and back walls of said body onto a centered stringer of said surfboard until said backing plates rest against said front and back walls, and wherein resin bonded thereto replaces shear strength lost due to the rout out opening necessary for a centered installation.

4. A receptacle according to claim 1 whereby said lid is a module which detaches and said straight edges of said lid serve as a wax scraper.

5. A modular receptacle according to claim 1 wherein said divider walls are equal in height to the upper surface of said ledge, and said ledge is formed below the top edge of said side, front and back walls an equal dimension as the thickness of said lid and said gasket, said recess in said lid upper surface being equal in depth as the thickness of said finger dial circular plate and said washer, and when said lid is secured to said body with said finger dial said lid and finger dial upper surface is flush with the top edge of said body and the divider walls within the body provide support to the center of said lid.

6. A modular receptacle according to claim 1 wherein said body, stringer clamps, lid and finger dial are formed of a durable slightly flexible plastic material, and the gasket and washer are formed of a compressible material.

* * * * *